US012434804B2

(12) United States Patent
Kuroyanagi

(10) Patent No.: US 12,434,804 B2
(45) Date of Patent: Oct. 7, 2025

(54) PERSONAL WATERCRAFT AND CONTROL METHOD FOR THE SAME

(71) Applicant: Kawasaki Motors, Ltd., Hyogo (JP)

(72) Inventor: Yoshiyuki Kuroyanagi, Akashi (JP)

(73) Assignee: KAWASAKI MOTORS, LTD., Hyogo (JP)

( * ) Notice: Subject to any disclaimer, the term of this patent is extended or adjusted under 35 U.S.C. 154(b) by 449 days.

(21) Appl. No.: 17/964,079

(22) Filed: Oct. 12, 2022

(65) Prior Publication Data

US 2024/0124115 A1 Apr. 18, 2024

(51) Int. Cl.
*B63H 25/46* (2006.01)
*B63H 25/04* (2006.01)

(52) U.S. Cl.
CPC ..... *B63H 25/46* (2013.01); *B63H 25/04* (2013.01)

(58) Field of Classification Search
CPC ..... B63H 25/00; B63H 25/04; B63H 25/44; B63H 25/46; B63H 21/00; B63H 21/22; B63H 11/00; B63H 11/08; F02D 11/00; F02D 11/02; B63B 35/00; B63B 35/73
USPC ..... 114/151; 440/1
See application file for complete search history.

(56) References Cited

U.S. PATENT DOCUMENTS 6,663,446 B2 * 12/2003 Bernier ..... F02D 11/02 440/1
7,163,425 B2 * 1/2007 Kamio ..... B63B 34/10 440/1

FOREIGN PATENT DOCUMENTS

JP 2005-231407 A 9/2005
JP 4425699 B2 * 3/2010 ..... B63B 34/10

* cited by examiner

*Primary Examiner* — Lars A Olson
(74) *Attorney, Agent, or Firm* — XSENSUS LLP

(57) ABSTRACT

A personal watercraft includes: a watercraft body; an operation unit operated by a driver aboard the watercraft body; a turning attitude detection unit that detects a turning attitude that is an attitude of the watercraft body when the driver performs operation of turning the watercraft body; a behavior adjustment actuator that adjusts behavior of the watercraft body; and a control unit that controls the behavior adjustment actuator based on the turning attitude detected by the turning attitude detection unit.

17 Claims, 6 Drawing Sheets

PERSONAL WATERCRAFT AND CONTROL METHOD FOR THE SAME

BACKGROUND

Technical Field

The present disclosure relates to a personal watercraft that planes on water.

Background Art

A jet propulsion personal watercraft described in JP 2005-231407A is known as a type of personal watercraft. In order to improve turning operability of a personal watercraft, it is desirable to facilitate the turning operation by performing control in accordance with the turning situation.

SUMMARY

The present disclosure has been made in view of the above circumstance, and an object thereof is to provide a personal watercraft capable of improving turning operability.

In order to solve the above problem, a personal watercraft according to one aspect of the present disclosure includes: a watercraft body; an operation unit operated by a driver aboard the watercraft body; a turning attitude detection unit that detects a turning attitude that is an attitude of the watercraft body when the driver performs operation of turning the watercraft body; a behavior adjustment actuator that adjusts behavior of the watercraft body; and a control unit that controls the behavior adjustment actuator based on the turning attitude detected by the turning attitude detection unit.

A personal watercraft according to another aspect of the present disclosure includes: a watercraft body; an operation unit operated by a driver aboard the watercraft body; a drive source that generates a drive force for causing the watercraft body to plane; a sensor that detects a roll angle that is an angle in a roll direction of the watercraft body with reference to a vertical line, or a roll angle change that is a change in the roll angle; and a control unit that reduces output of the drive source in a case where the roll angle or the roll angle change detected by the sensor exceeds a predetermined reference value while the driver is performing operation of turning the watercraft body.

A control method according to still another aspect of the present disclosure is a method for controlling a personal watercraft including a watercraft body and an operation unit operated by a driver aboard the watercraft body, the method including: detecting a turning attitude that is an attitude of the watercraft body when the driver is performing operation of turning the watercraft body; and adjusting behavior of the watercraft body such that the turning attitude returns to a predetermined reference when the turning attitude having been detected deviates from the reference.

DETAILED DESCRIPTION

Hereinafter, an embodiment of a personal watercraft according to the present disclosure will be described with reference to the drawings. Some of the drawings are given indications of front, rear, left, and right directions, and these directions coincide with directions viewed from the driver on the personal watercraft.

[Configuration of Personal Watercraft]

Figure 1:
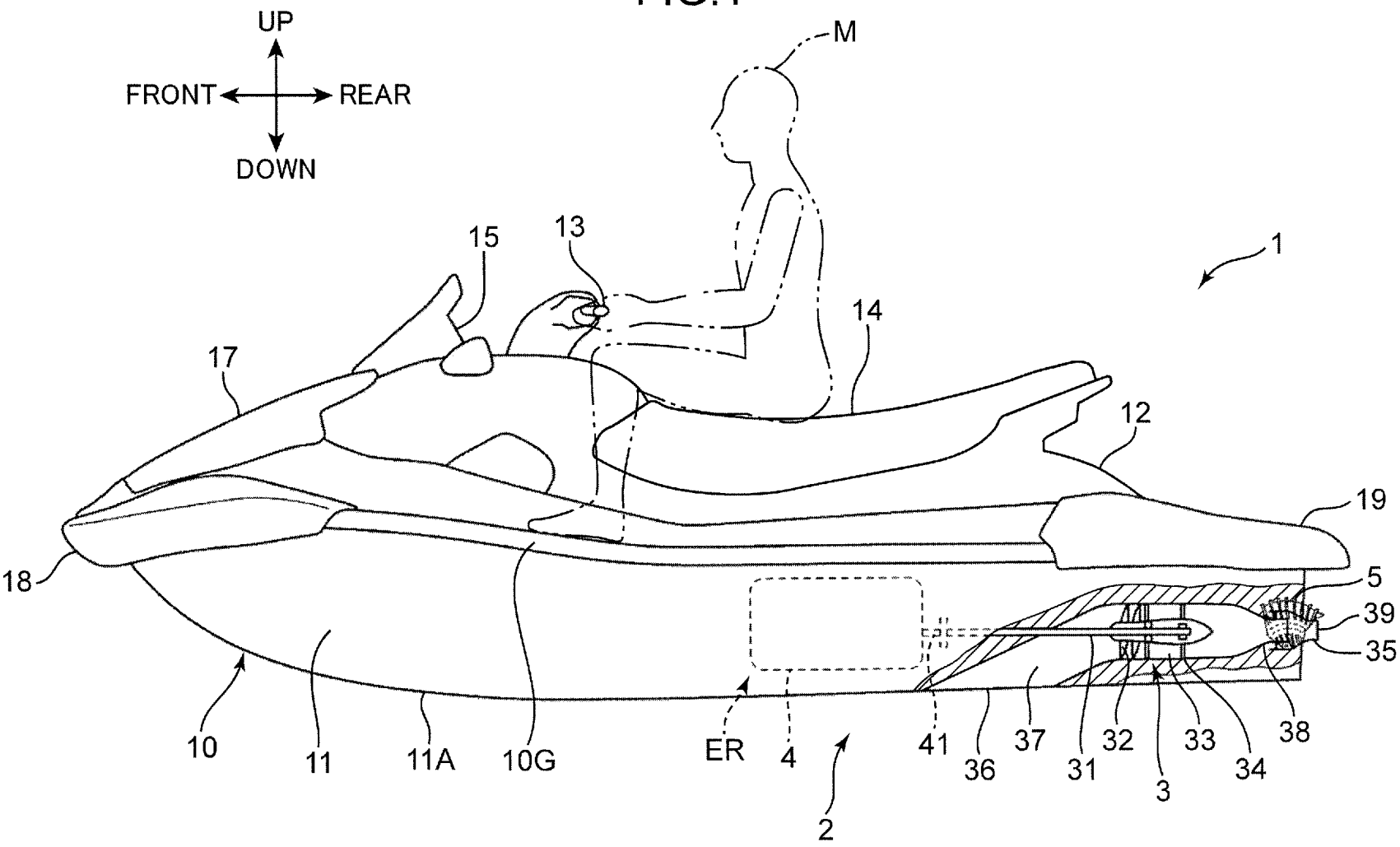
FIG. 1 is a partially broken side view of a personal watercraft according to an embodiment of the present disclosure.
Figure 2:
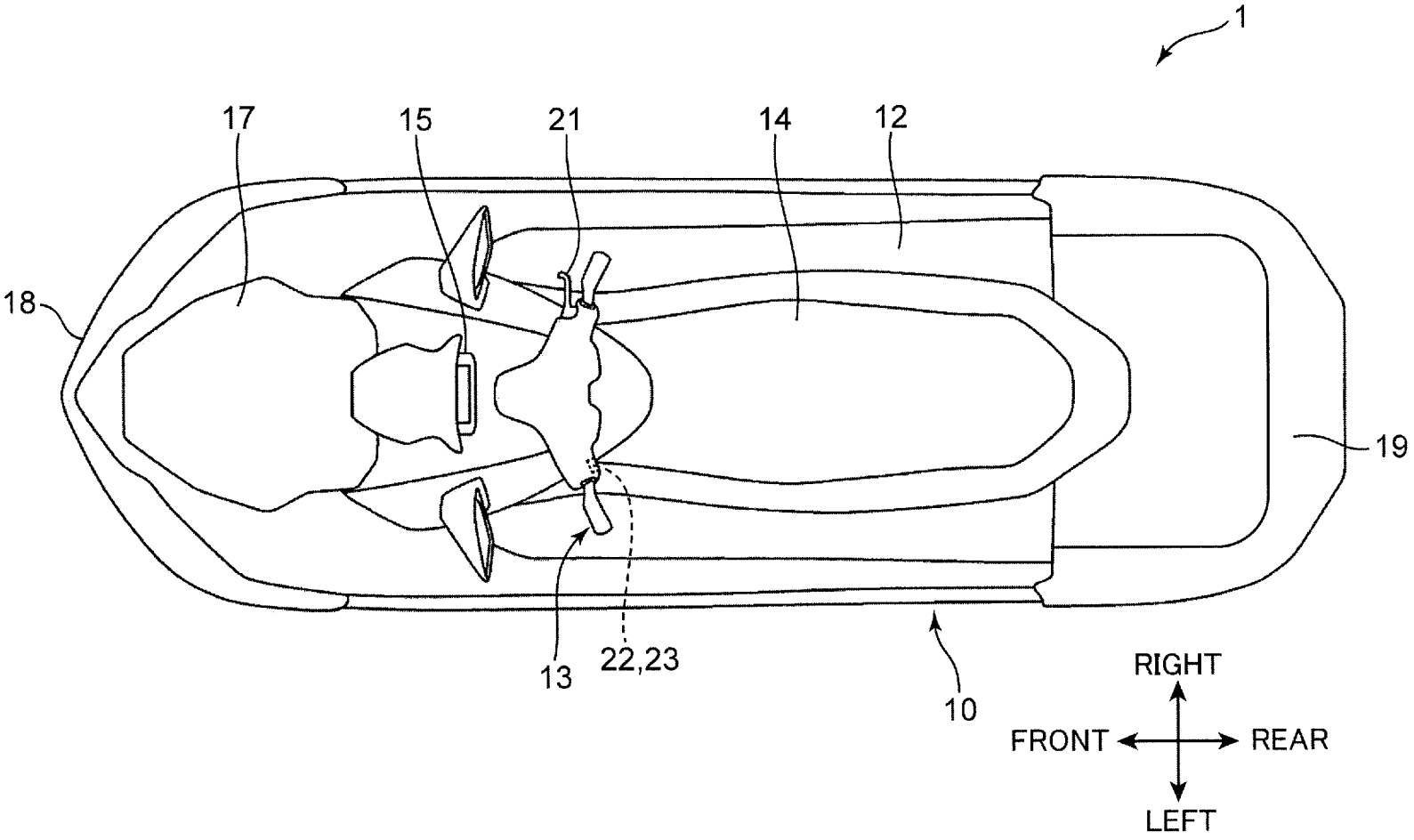
FIG. 2 is a plan view of the personal watercraft.

FIG. 1 is a partially broken side view of a personal watercraft 1 according to an embodiment of the present disclosure, and FIG. 2 is a plan view of the personal watercraft 1. The personal watercraft 1 is a straddle-type watercraft called a PWC that injects a water flow rearward and navigates in reaction to the water flow. The personal watercraft 1 includes a watercraft body 10, a power unit 2 that generates a propulsive force for moving the watercraft body 10 on water, and a controller 7 (FIG. 3) that controls the power unit 2.

The watercraft body 10 includes a hull 11 and a deck 12 that covers the hull 11. The hull 11 and the deck 12 are connected to each other over the entire circumference by a gunwale line 10G. A rear region of a bottom surface 11A of the hull 11 is provided with a water inlet port 36, and an impeller passage 37 extending rearward with the water inlet port 36 as an inlet is formed so as to penetrate a rear part of the hull 11 in the front-rear direction. The power unit 2 applies a propulsive force to the watercraft body 10 by injecting rearward, through the impeller passage 37, water taken in from the water inlet port 36.

The deck 12 includes a front hatch 17, a front bumper 18, and a rear cover 19. The front hatch 17 covers an upper opening of a luggage storage space provided in a front part of the deck 12. The front bumper 18 covers the foremost part of the watercraft body 10. The rear cover 19 is arranged at rear of a seat 14 described later so as to cover the hull 11 and is used, for example, when a passenger returns from the water to the watercraft body 10. The rear cover 19 can also be used as luggage storage (extension deck) for placing luggage, for example.

The deck 12 is provided with a handle 13, the seat 14, and a display 15. The seat 14 is a seat on which a driver M who drives the personal watercraft 1 is seated. The handle 13 is a steering handle operated by the driver M for steering the personal watercraft 1. The display 15 is an indicator that displays various types of information related to the navigation of the personal watercraft 1, such as a planing speed, a remaining amount of fuel, and an operation mode.

The handle 13 is disposed at a front upper part of the deck 12. As illustrated in FIG. 2, the handle 13 is provided with an accelerator 21, a start switch 22, and a stop switch 23. The accelerator 21 is an operation lever for adjusting the planing speed of the personal watercraft 1 (watercraft body 10). The start switch 22 is a switch for starting an engine 4. The stop switch 23 is a switch for stopping the engine 4. In the present embodiment, the start switch 22 and the stop switch 23 are configured by a common push-button switch, and are provided at positions on the handle 13 opposite (left side) to the accelerator 21.

The seat 14 extends in the front-rear direction at rear of the handle 13 and is disposed so as to partially cover the upper surface of the deck 12. The seat 14 is only required to be a seat on which at least the driver M can be seated. That is, the seat 14 may be a multiple-passenger seat on which not only the driver M but also fellow passengers can be seated, or may be a single-passenger seat on which only the driver M can be seated.

The display 15 is disposed in front of the handle 13. The display 15 has a function as an operation unit that receives a touch operation of the driver M in addition to the above-described function of displaying various types of information regarding the navigation of the personal watercraft 1. That is, the display 15 is a liquid crystal touchscreen display including a touch sensor that responds to a touch operation of the driver M. A mode changeover switch 24 (FIG. 3) is displayed on the display 15. The mode changeover switch 24 is a touch switch for selecting the operation mode of the personal watercraft 1. The mode changeover switch 24 corresponds to the "mode selection unit" in the present disclosure.

In the present embodiment, at least two types of modes, a normal mode and a beginner mode, are prepared as the operation mode selectable by the mode changeover switch 24. The beginner mode is an operation mode assuming that the driver M is a beginner. In this beginner mode, for example, the maximum output of the engine 4 or the maximum speed of the personal watercraft 1 is limited. The normal mode is an operation mode assuming that the driver M is not a beginner. In this normal mode, the above-described limitation (for example, limitation on the output or the speed) in the beginner mode is not applied. The mode changeover switch 24 is provided on the display 15 in an aspect capable of discretionarily switching the operation mode between the beginner mode and the normal mode. The normal mode corresponds to the "first output mode" in the present disclosure, and the beginner mode corresponds to the "second output mode" in the present disclosure.

A watercraft speed sensor 51, a steering angle sensor 52, an IMU 53, and a GPS receiver 54 (see FIG. 3) are attached to different parts of the watercraft body 10. The watercraft speed sensor 51 is a sensor that detects the planing speed of the watercraft body 10. The steering angle sensor 52 is a sensor attached to a shaft (stem) of the handle 13 in order to detect the steering angle of the handle 13. The IMU 53 is an inertial measurement unit in which a three-axis gyro sensor and a three-axis acceleration sensor are combined, and can detect the angular velocity around three axes orthogonal to one another and the acceleration in three axis directions in the personal watercraft 1. The GPS receiver 50 is a receiver that acquires position information of the personal watercraft 1, and can receive signals transmitted from GPS satellites and specify the global position of the personal watercraft 1 based on the received signals. The IMU 53 corresponds to the "turning attitude detection unit" or the "pitch angle sensor" in the present disclosure, and the GPS receiver 50 corresponds to the "position information acquisition unit" in the present disclosure.

A mounted object sensor 55 (FIG. 3) is further attached to the watercraft body 10. The mounted object sensor 55 is a sensor that detects a mounted object other than the driver M. The mounted object mentioned here may be an occupant other than the driver M, that is, a fellow passenger, or may be luggage. The mounted object sensor 55 may be a sensor that determines the presence or absence of a mounted object based on the weight applied to the seat 14 or the rear cover 19, for example, or may be a sensor that optically detects the presence or absence of a mounted object.

As illustrated in FIG. 1, the power unit 2 includes the engine 4, a jet pump 3 that is driven by the engine 4 to inject water, and a reverse bucket 5 disposed at an outlet of the jet pump 3.

The engine 4 is, for example, a water-cooled four-stroke multicylinder engine using gasoline as fuel, and is a drive source that generates a drive force for driving the jet pump 3. The engine 4 is accommodated in an engine room ER formed inside the hull 11. The engine 4 includes a crankshaft 41 extending in the front-rear direction as an output shaft.

The jet pump 3 is a pump that generates a jet water flow injected rearward by pressurizing and accelerating the water taken into the impeller passage 37 from the water inlet port 36. The jet pump 3 includes a pump shaft 31, an impeller 32, a stator vane 33, a pump case 34 and a jet nozzle 35.

The pump shaft 31 is coaxially coupled to a rear end of the crankshaft 41. The impeller 32 is attached to a rear end part of the pump shaft 31. The drive force of the engine 4 is transmitted to the impeller 32 via the crankshaft 41 and the pump shaft 31 to rotate the impeller 32 about the axis. The impeller 32 generates a jet water flow by rotating. The stator vane 33 is attached at rear of the impeller 32 and straightens a jet water flow generated by the impeller 32. The pump case 34 is disposed at the rear of the impeller 32 and rotatably supports the rear end part of the pump shaft 31.

The jet nozzle 35 is a nozzle having an injection port 39 for injecting a jet water flow generated by the impeller 32, and is disposed at the rear of the pump case 34. The jet nozzle 35 has a tapered shape in which the passage cross-sectional area decreases rearward. The jet nozzle 35 is supported by the watercraft body 10 via a first support shaft extending in the up-down direction and a second support shaft extending in the left-right direction. In other words, the jet nozzle 35 is supported to be swingable (tiltable) in the left-right direction and the up-down direction.

The jet nozzle 35 is linked to the handle 13 via a cable or the like so as to swing left and right about the first support shaft in accordance with steering of the handle 13. When the jet nozzle 35 is swung by the handle 13, the injecting direction of the jet water flow from the injection port 39 is changed left or right, thereby changing the traveling direction of the personal watercraft 1.

The jet nozzle 35 is coupled with a deflection motor 27 (FIG. 3) in an interlocking manner. The deflection motor 27 is an electric motor that tilts the jet nozzle 35 up and down about the second support shaft. When the jet nozzle 35 is tilted by the deflection motor 27, the injecting direction of the jet water flow from the injection port 39 is changed up or down, whereby the attitude of the personal watercraft 1 during planing is adjusted. For example, during planing, the personal watercraft 1 tends to be in an attitude of tilting so that the bow is positioned above the stern, but this tendency is suppressed by increasing the downward tilt angle of the jet nozzle 35. This is because the downward component of the jet water flow brings about an action of lifting the stern (in other words, an action of lowering the bow).

The deflection motor 27 can be used for application of changing the up-down tilt angle of the jet nozzle 35 in accordance with the operation mode, for example. That is, the application is, for the purpose of stabilizing the attitude of the watercraft body 10 in the beginner mode, to increase the downward tilt angle of the jet nozzle 35 in the beginner mode as compared with the normal mode. In the present embodiment, the deflection motor 27 is also used for application of drive assist for assisting the turning operation of the personal watercraft 1 by the driver M (details will be described later).

The rear end part of the impeller passage 37 is a tapered part 38 in which the passage cross-sectional area decreases rearward. A rear part of the tapered part 38 enters the jet nozzle 35. The water taken into the impeller passage 37 from the water inlet port 36 is sent to the tapered part 38 and the jet nozzle 35 while being pressurized and accelerated in accordance with rotation of the impeller 32, and is injected at a high speed from the outlet of the jet nozzle 35 having a narrowed passage cross-sectional area, that is, the injection port 39.

The reverse bucket 5 is rotatable in the up-down direction by being supported via a support shaft extending in the left-right direction by a component (pump cover) constituting a lower rear end part of the watercraft body 10. Specifically, the reverse bucket 5 is movable among a forward position illustrated in FIG. 1 in which the reverse bucket 5 is rotated upward so as not to cover the injection port 39 of the jet nozzle 35 and a reverse position in which the reverse bucket 5 is rotated downward so as to cover the injection port 39 of the jet nozzle 35 from the rear. When the reverse bucket 5 is in the forward position (FIG. 1), the jet water flow from the injection port 39 is jetted rearward, so that a forward propulsive force is applied to the watercraft body 10 and the personal watercraft 1 moves forward. On the other hand, when the reverse bucket 5 is in the reverse position, the jet water flow from the injection port 39 is bent forward by the reverse bucket 5, whereby the moving direction of the personal watercraft 1 is changed to rearward.

[Control of Personal Watercraft]

Figure 3:
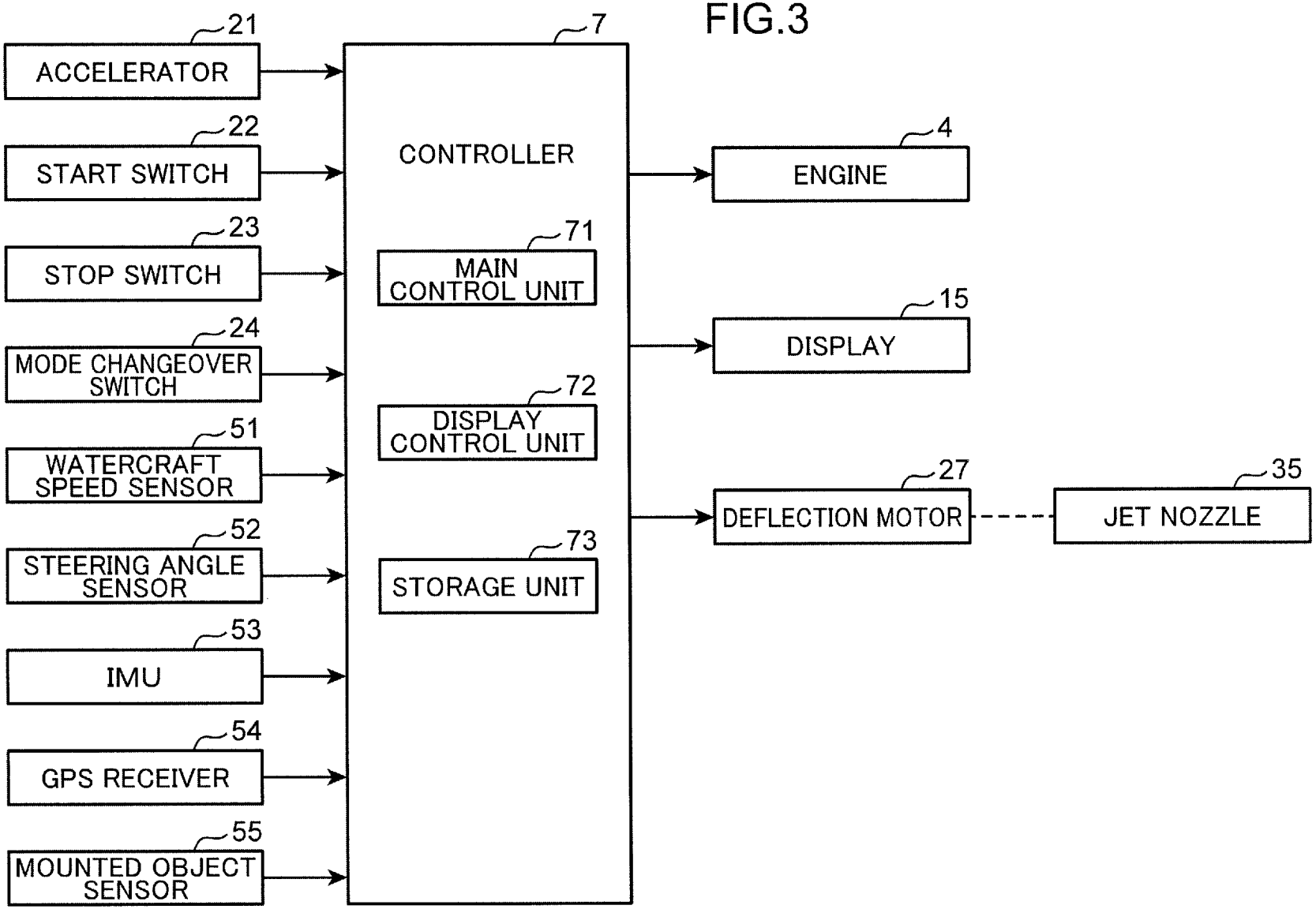
FIG. 3 is a functional block diagram illustrating a control system of the personal watercraft.

FIG. 3 is a functional block diagram illustrating a control system of the personal watercraft 1. As illustrated in FIG. 3, the controller 7 receives input signals from the switches and the sensors described above, and outputs control signals to control targets of respective units. That is, the controller 7 is electrically connected to the accelerator 21, the start switch 22, the stop switch 23, the mode changeover switch 24, the watercraft speed sensor 51, the steering angle sensor 52, the IMU 53, the GPS receiver 54, and the mounted object sensor 55, and receives operation signals or detection signals output from these elements. The controller 7 is electrically connected to the engine 4, the display 15, and the deflection motor 27, and outputs control signals to these elements. Regarding control of the engine 4, the controller 7 controls output of the engine 4 and operation such as start/stop of the engine 4 by controlling elements such as a fuel injection valve and an ignition plug included in the engine 4.

The controller 7 is a control device including, as a main part, a microcomputer including a processor (CPU) that performs calculation, memories such as a ROM and a RAM, and various input/output buses. The controller 7 functionally includes a main control unit 71, a display control unit 72, and a storage unit 73. The main control unit 71 is a module that mainly performs control regarding planing operation of the personal watercraft 1. The display control unit 72 is a module that performs display control of the display 15. The storage unit 73 is a module that stores various data related to control of the main control unit 71 and the display control unit 72. The controller 7 corresponds to the "control unit" in the present disclosure.

Figure 4:
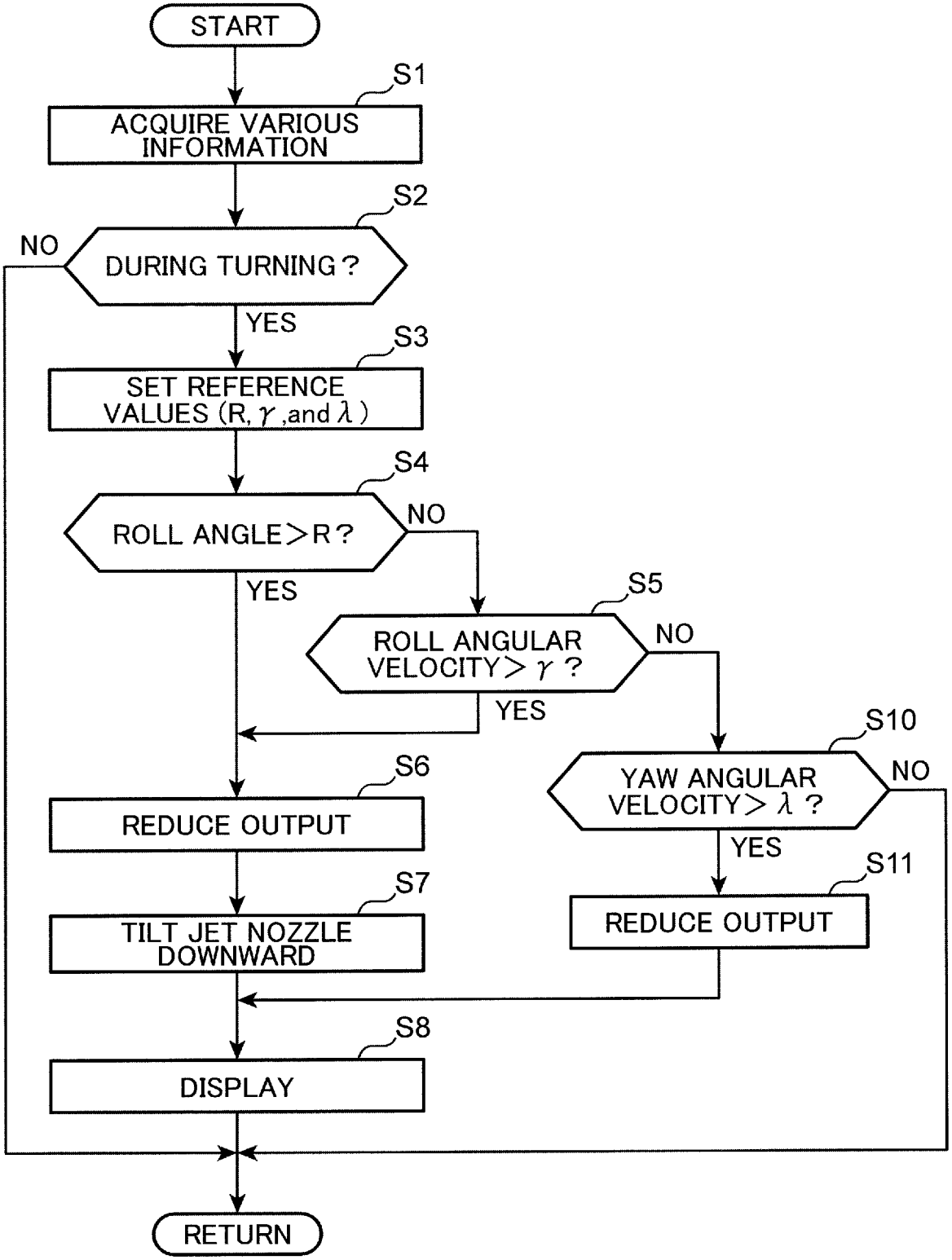
FIG. 4 is a flowchart illustrating content of drive assist control for the personal watercraft.

Next, content of the control performed by the controller 7 described above will be described with reference to the flowchart illustrated in FIG. 4. The control of this flowchart is started at the time point when the driver M performs on operation on the start switch 22 to start the engine 4. After the start of the present control, based on input from the switches and the sensors, the main control unit 71 of the controller 7 acquires, as various types of information regarding the personal watercraft 1, information including the operation mode, the planing speed, the steering angle, the acceleration information, the angle information, the position information, and information on the mounted object (step S1). That is, the main control unit 71 acquires information on the operation mode of the personal watercraft 1 based on input from the mode changeover switch 24, acquires the planing speed of the watercraft body 10 based on input from the watercraft speed sensor 51, acquires the steering angle of the handle 13 based on input from the steering angle sensor 52, acquires acceleration information and angle information on the watercraft body 10 based on input from the IMU 53, acquires position information of the watercraft body 10 based on input from the GPS receiver 54, and acquires information on the mounted object on the watercraft body 10 (presence or absence of a mounted object) based on input from the mounted object sensor 55.

Here, the acceleration information on the watercraft body 10 acquired in step S1 includes lateral acceleration acting on the watercraft body 10. The lateral acceleration is acceleration generated at the time of turning of the watercraft body 10, and corresponds to the centrifugal force acting on the watercraft body 10. In other words, in step S1, the main control unit 71 acquires information including the centrifugal force acting on the watercraft body 10.

Figure 5A:
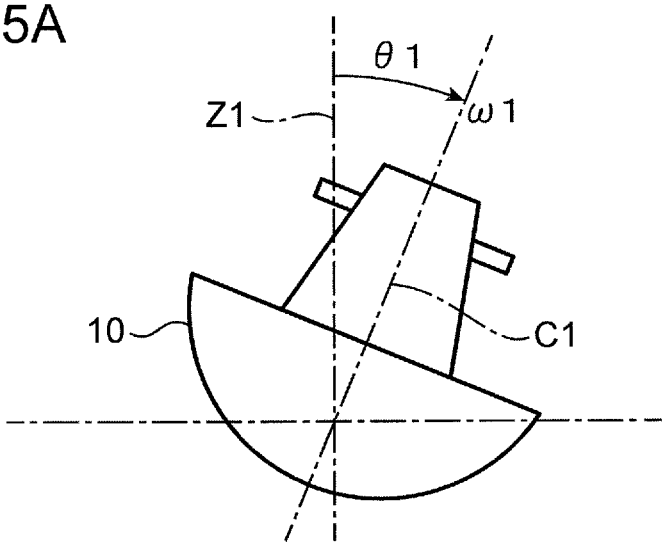
FIG. 5A is a schematic diagram for describing a roll angle and a roll angular velocity of a watercraft body.
Figure 5B:
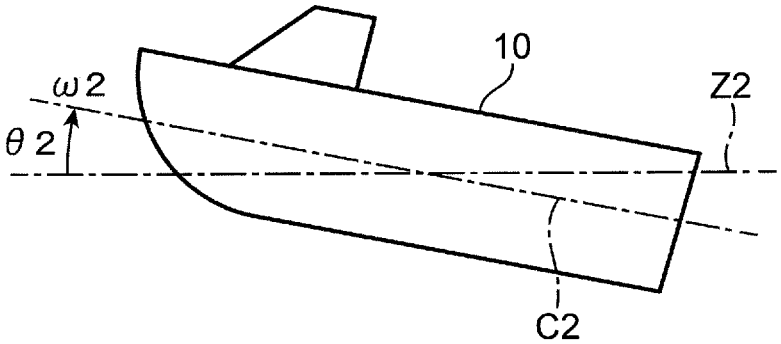
FIG. 5B is a schematic diagram for describing a pitch angle and a pitch angular velocity of a watercraft body.
Figure 5C:
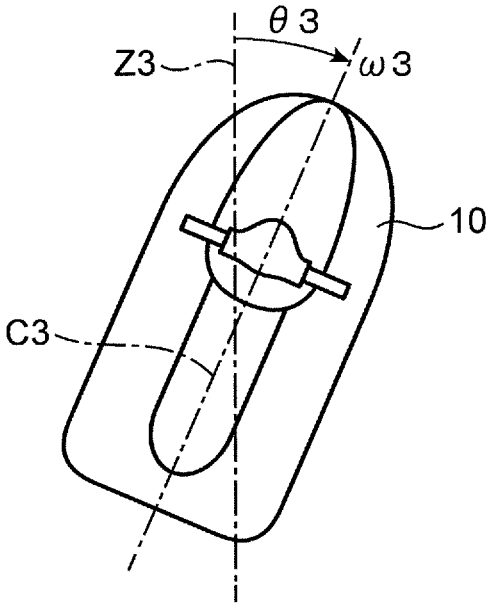
FIG. 5C is a schematic diagram for describing a yaw angle and a yaw angular velocity of a watercraft body.

The angle information on the watercraft body 10 acquired in step S1 includes information regarding each angle (roll angle, pitch angle, and yaw angle) of the watercraft body 10 illustrated in FIGS. 5A to 5C. In the present specification, an action in which the watercraft body 10 tilts about an axis extending in the front-rear direction in the front view illustrated in FIG. 5A is defined as rolling, an action in which the watercraft body 10 tilts about an axis extending in the left-right direction in the side view illustrated in FIG. 5B is defined as pitching, and an action in which the watercraft body 10 rotates about an axis extending in the vertical direction in the plan view illustrated in FIG. 5C is defined as yawing. An angle at which a center axis C1 of the watercraft body 10 tilts leftward or rightward with respect to a vertical line Z1 in the front view (FIG. 5A), that is, an angle in the roll direction with respect to the vertical line Z1 is defined as a roll angle θ1, and a temporal change rate of the roll angle θ1 is defined as a roll angular velocity ω1. Similarly, an angle at which a center line C2 of the watercraft body 10 tilts upward with respect to a horizontal line Z2 in the side view (FIG. 5B), that is, an angle in the upper pitch direction with respect to the horizontal line Z2 is defined as a pitch angle θ2, and a temporal change rate of the pitch angle θ2 is defined as a pitch angular velocity ω2. An angle at which a center axis C3 of the watercraft body 10 rotates with respect to a predetermined reference line Z3 in plan view (FIG. 5C), that is, an angle in the yaw direction of the watercraft body 10 is defined as a yaw angle θ3, and a temporal change rate of the yaw angle θ3 is defined as a yaw angular velocity ω3.

In the case of the present embodiment, in step S1, the main control unit 71 acquires, as angle information on the watercraft body 10, information including the values of the roll angle θ1, the roll angular velocity ω1, the pitch angle θ2, and the yaw angular velocity ω3 described above. Among these, the roll angle θ1, the roll angular velocity ω1, and the yaw angular velocity ω3 are used as parameters representing the turning attitude of the watercraft body 10. On the other hand, the pitch angle θ2 is used as a parameter for correcting the reference (reference values R, γ, and λ described later) of the turning attitude.

When the acquisition of various types of information is completed as described above, the main control unit 71 determines whether or not the watercraft body 10 is turning (step S2). Specifically, the main control unit 71 determines whether or not the watercraft body 10 is turning based on at least one of the steering angle of the handle 13 and the centrifugal force of the watercraft body 10 acquired in step S1. For example, when the steering angle is larger than a predetermined threshold or when the centrifugal force is larger than a predetermined threshold, it can be determined that the watercraft body 10 is turning, that is, the watercraft body 10 is moving so as to draw an arc-shaped route in plan view.

If the determination is YES in step S2 and turning is confirmed, the main control unit 71 sets a reference value used in each determination of steps S4, S5, and S10 described later (step S3). That is, based on the specific parameter group acquired in step S1, the main control unit 71 sets a reference roll angle R used as the reference (threshold) in the determination (S4) regarding the roll angle θ1, a reference roll angular velocity γ used as the reference (threshold) in the determination (S5) regarding the roll angular velocity ω1, and a reference yaw angular velocity λ used as the reference (threshold) in the determination (S10) regarding the yaw angular velocity ω3. The reference roll angle R, the reference roll angular velocity γ, and the reference yaw angular velocity λ are all positive values.

Specifically, in step S3, the reference values (R, γ, and λ) are variably set based on the parameters of the operation mode, the planing speed, the steering angle, the pitch angle, and the mounted object that have been acquired in step S1. The relationship between each parameter and the reference value can be appropriately set in accordance with required characteristics, and in the present embodiment, the reference value is set with the following tendency.

(i) When the operation mode is the beginner mode, the reference value is made smaller than that in the normal mode.

(ii) The larger the planing speed is, the larger the reference value is made.

(iii) The larger the steering angle is, the larger the reference value is made.

(iv) The larger the pitch angle θ2 is, the smaller the reference value is made.

(v) When the mounted object is present, the reference value is made smaller than that when the mounted object is absent.

As described later, the reference value is a threshold for determining whether or not to perform drive assist (drive assist control) for stabilizing the turning attitude, and the smaller the reference value is, the earlier the drive assist is performed. The reason why such reference value is set to the tendencies (i) to (v) is as follows.

The reason why the reference value is set with the above tendency (i) is to increase the drive assist for beginners. For example, decreasing the reference roll angle R means that drive assist is performed from a stage where the roll angle θ1 is relatively small. This prevents excessive tilt and attitude change of the watercraft body 10 and facilitates turning operation by beginners.

The setting of the reference value with the tendencies (ii) and (iii) is setting in consideration of the centrifugal force acting on the watercraft body 10. That is, the larger the planing speed or the steering angle during turning is, the larger the centrifugal force acting on the watercraft body 10 becomes. When the centrifugal force becomes large, the roll angle θ1 suitable for smooth turning also becomes large, and the allowable attitude change also becomes large. In other words, the larger the centrifugal force acting on the watercraft body 10 is, the more the attitude range requiring no drive assist expands. The settings of (ii) and (iii) in which the reference value is made larger as the planing speed or the steering angle is larger takes into consideration such an effect of centrifugal force, and enables drive assist at an appropriate timing in consideration of a difference in centrifugal force.

The setting of the reference value with the tendency of (iv) is set in consideration of the fact that the larger the pitch angle θ2 of the watercraft body 10 is, the smaller the allowable level of the other angles (roll angle θ1 and the like) becomes. That is, when the pitch angle θ2 is large and the bow is greatly raised, the sinking degree of the watercraft body 10 underneath the surface decreases, and the planing resistance of the watercraft body 10 decreases. For this reason, the watercraft body 10 may become unstable even in a stage where another angle such as the roll angle θ1 or its change is relatively small. The setting of (iv) in which the reference value is made smaller as the pitch angle θ2 is larger leads to prevention of destabilization of the watercraft body 10 due to such a reason.

The setting of the reference value with the tendency of (v) is to suppress separation (falling overboard) of a mounted object from the watercraft body 10. That is, in a case where a mounted object such as a fellow passenger or luggage is mounted on the watercraft body 10, the mounted object may be separated from the watercraft body 10 when the tilt or attitude change of the watercraft body 10 becomes large. The setting of (v) in which the reference value is made small when there is a mounted object leads to suppression of separation of the mounted object due to such a reason.

When the setting of the reference values (R, γ, and λ) is completed as described above, the main control unit 71 determines whether or not the roll angle θ1 is larger than the reference value (step S4). That is, the main control unit 71 determines whether or not the roll angle θ1 acquired in step S1 is larger than the reference roll angle R set in step S3.

If the determination is NO in step S4 and it is confirmed that the roll angle θ1 is equal to or less than the reference roll angle R, the main control unit 71 determines whether or not the roll angular velocity ω1 is larger than the reference value (step S5). That is, the main control unit 71 determines whether or not the roll angular velocity ω1 acquired in step S1 is larger than the reference roll angular velocity 7 set in step S3.

If the determination is YES in either step S4 or step S5, that is, if it is confirmed that the roll angle θ1 is larger than the reference roll angle R or that the roll angular velocity ω1 is larger than the reference roll angular velocity γ, the main control unit 71 reduces the output of the engine 4 (step S6). That is, the main control unit 71 controls elements such as a fuel injection valve and an ignition plug of the engine 4 so that the output of the engine 4 is reduced by a predetermined amount.

Next, the main control unit 71 tilts the jet nozzle 35 downward (step S7). That is, the main control unit 71 drives the deflection motor 27 (FIG. 3) to tilt the jet nozzle 35 downward so that the downward tilt angle of the jet nozzle 35 increases by a predetermined amount.

Here, the fact that the determination in step S4 is YES (θ1>R) means that the leftward or rightward tilt of the watercraft body 10 with respect to the vertical line Z1 is considerably large, and the fact that the determination in step S5 is YES (ω1>γ) means that the increase rate of the tilt of the watercraft body 10 with respect to the vertical line Z1 is considerably large. The control in steps S6 and S7 performed in such a situation corresponds to drive assist control for stabilizing the turning attitude of the watercraft body 10. That is, both output reduction of the engine 4 and angle change of the jet nozzle 35 (downward tilt) by steps S6 and S7 act in a direction to return the tilt of the watercraft body 10. Due to this, the roll angular velocity ω1 is reduced and an increase in the roll angle θ1 is suppressed, and drive assist is achieved.

The output reduction amount of the engine 4 in step S6 and the angle change amount of the jet nozzle 35 in step S7 can be appropriately set in accordance with the condition at the time point of determination in step S4 or S5. For example, the output reduction amount and angle change amount can be variably set in accordance with an excess amount (θ1−R) of the roll angle θ1 with respect to the reference value, an excess amount (ω1−γ) of the roll angular velocity col with respect to the reference value, and the yaw angular velocity ω3. In this case, the output reduction amount and angle change amount are preferably increased as each of the excess amount of the roll angle θ1, the excess amount of the roll angular velocity ω1, and the yaw angular velocity ω3 is large. The output reduction amount and angle change amount can be set to predetermined constant amounts.

After start of the drive assist control by steps S6 and S7, the display control unit 72 of the controller 7 causes the display 15 to display predetermined content indicating that the drive assist control is being executed (step S8). Here, the content displayed on the display 15 is of any type as long as the driver M can understand that the drive assist control is being executed, and for example, some message, pattern (icon), or the like can be displayed on the display 15.

Next, control in a case where the determination is NO in step S5, that is, in a case where both the roll angle θ1 and the roll angular velocity ω1 are equal to or less than the reference values (R and γ) will be described. In this case, the main control unit 71 determines whether or not the yaw angular velocity ω3 is larger than the reference value (step S10). That is, the main control unit 71 determines whether or not the yaw angular velocity ω3 acquired in step S1 is larger than the reference yaw angular velocity λ set in step S3.

If the determination is NO in step S10 and it is confirmed that the yaw angular velocity ω3 is equal to or less than the reference yaw angular velocity λ, the flow is returned to step S1. That is, the drive assist control is not performed.

On the other hand, if the determination is YES in step S10 and it is confirmed that the yaw angular velocity ω3 is larger than the reference yaw angular velocity λ, the main control unit 71 reduces the output of the engine 4 (step S11). That is, by controlling elements such as a fuel injection valve and an ignition plug of the engine 4, the main control unit 71 reduces the output of the engine 4 by a predetermined amount.

Here, the fact that the determination in step S10 is YES (θ3>λ) means that the rotation speed of the watercraft body 10 around the vertical axis is considerably large. The control in step S11 performed in such a situation corresponds to drive assist control for stabilizing the turning attitude of the watercraft body 10. That is, the output reduction of the engine 4 by step S11 acts in a direction of suppressing the rotation of the watercraft body 10. Due to this, the yaw angular velocity ω3 is reduced, and drive assist is achieved.

The output reduction amount of the engine 4 in step S11 can be appropriately set in accordance with the condition at the time point of determination in step S10. For example, the output reduction amount can be variably set in accordance with an excess amount (ω3−λ) of the yaw angular velocity ω3 with respect to the reference value. In this case, the output reduction amount is preferably increased as the excess amount of the yaw angular velocity ω3 is large. The output reduction amount can be set to predetermined constant amounts.

After start of the drive assist control by step S11, the display control unit 72 causes the display 15 to display predetermined content indicating that the drive assist control is being executed (step S8).

Figure 6:
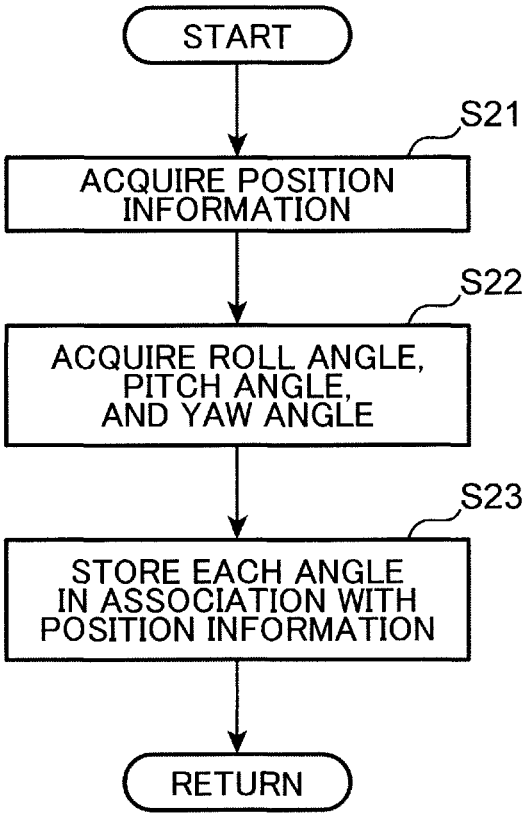
FIG. 6 is a flowchart illustrating content of log storage processing of a turning attitude.

Next, the content of log storage processing performed in parallel with the above-described control (drive assist control) of FIG. 4 will be described with reference to FIG. 6. When the control of FIG. 6 starts, the main control unit 71 acquires the position information of the watercraft body 10 based on the input from the GPS receiver 54 (step S21), and acquires each of the roll angle θ1, the pitch angle θ2, and the yaw angle θ3 of the watercraft body 10 based on the input from the IMU 53 (step S22).

Next, the main control unit 71 stores each of the angles θ1 to θ3 acquired in step S22 into the storage unit 73 in association with the position information acquired in step S21. Due to this, the storage unit 73 stores information on each of the roll angle θ1, the pitch angle θ2, and the yaw angle θ3 for each passing positions so far of the watercraft body 10. The stored information can be used later as a history of the turning attitude.

[Operation and Effects]

As described above, in the present embodiment, during turning of the watercraft body 10, the roll angle θ1, the roll angular velocity ω1, and the yaw angular velocity ω3 are detected as parameters representing the attitude (turning attitude) of the watercraft body 10, and the drive assist control is appropriately executed based on the detected parameters. For example, when the roll angle θ1 is larger than the reference roll angle R or the roll angular velocity ω1 is larger than the reference roll angular velocity γ, the control (S6) for reducing the output of the engine 4 and the control (S7) for increasing the downward tilt angle of the jet nozzle 35 are executed together as the drive assist control. When the yaw angular velocity ω3 is larger than the reference yaw angular velocity λ, the control (S11) for reducing the output of the engine 4 is executed as the drive assist control. According to such a configuration, there is an advantage that the operation load when the driver M performs turning operation can be reduced.

That is, in the present embodiment, when the roll angle θ1 or the roll angular velocity ω1 of the watercraft body 10 exceeds the respective reference values (R and γ), the control (S6 and S7) for reducing the output of the engine 4 and increasing the downward tilt angle of the jet nozzle 35 is executed, and therefore as a result of these controls acting in a direction of suppressing the tilt (rolling) of the watercraft body 10 with respect to the vertical line Z1, the roll angular velocity ω1 can be reduced to suppress an increase in the roll angle θ1. This allows the roll attitude during turning to be stabilized to assist the turning operation of the driver M, and the operation load to be reduced.

Similarly, when the yaw angular velocity ω3 of the watercraft body 10 exceeds the reference yaw angular velocity λ, the control (S11) for reducing the output of the engine 4 is executed, and therefore as a result of this control acting in a direction of suppressing the rotation (yawing) of the watercraft body 10 about the vertical axis, the yaw angular velocity ω3 can be reduced. This allows the yaw attitude during turning to be stabilized to assist the turning operation of the driver M, and the operation load to be reduced.

In the present embodiment, the above-described reference roll angle R, the reference roll angular velocity γ, and the reference yaw angular velocity λ, which are thresholds (references) for determining whether or not to perform drive assist control, are variably set in accordance with the respective parameters of the operation mode, the planing speed, the steering angle, the pitch angle θ2, and the mounted object, and therefore the timing of the drive assist can be optimized.

Specifically, change in each reference value (R, γ, and λ) in accordance with the operation mode enables drive assist at an appropriate timing in consideration of a difference in operation mode. For example, when the operation mode is the beginner mode, by performing the drive assist early, it is possible to facilitate turning operation of the beginners.

Change in each reference value in accordance with the turning speed and the steering angle enables drive assist at an appropriate timing in consideration of a difference in centrifugal force acting on the watercraft body 10. Similarly, the setting of each reference value in accordance with the pitch angle θ2 enables drive assist at an appropriate timing in consideration of the difference in sinking degree of the watercraft body 10 underneath the surface, in other words, planing resistance of the watercraft body 10. This can advance the timing of drive assist as the watercraft body 10 is in a situation of being more likely to be unstable, and can stabilize the turning attitude of the watercraft body 10.

Furthermore, change in each reference value in accordance with the mounted object enables drive assist at an appropriate timing in consideration of the presence or absence of the mounted object. For example, by performing early drive assist when there is a mounted object, it is possible to suppress separation (falling overboard) of the mounted object from the watercraft body 10.

In the present embodiment, since each piece of information of the roll angle θ1, the pitch angle θ2, and the yaw angle θ3 of the watercraft body 10 are stored in the storage unit 73 in association with the position information of the watercraft body 10, a history of the turning attitude can be provided to the driver M using the stored information, for example.

Modifications

In the above embodiment, the roll angle θ1, the roll angular velocity ω1, and the yaw angular velocity ω3 are detected as parameters representing the attitude (turning attitude) of the watercraft body 10 during turning of the watercraft body 10, but the parameters detected as the turning attitude are not limited thereto. For example, the roll angular acceleration that is the temporal change rate of the roll angular velocity ω1, or the yaw angular acceleration that is the temporal change rate of the yaw angular velocity ω3 may be detected. The pitch angle θ2, the pitch angular velocity that is the temporal change rate of the pitch angle θ2, and the pitch angular acceleration that is the temporal change rate of the pitch angular velocity may be detected. In other words, the parameters that can be detected as turning attitude in the present disclosure can be one or more appropriate parameters selected from the roll angle and the pitch angle, the roll angle change which is a change in the roll angle, the pitch angle change which is a change in the pitch angle, and the yaw angle change which is a change in the yaw angle. In this case, the concept of roll angle change includes the roll angular velocity and the roll angular acceleration, the concept of pitch angle change includes the pitch angular velocity and the pitch angular acceleration, and the yaw angle change includes the yaw angular velocity and the yaw angular acceleration. Furthermore, parameters other than each of the angles of roll, pitch, and yaw and their changes may be detected as parameters representing the turning attitude. As an example, the sinking amount of the watercraft body 10 underneath the surface may be detected as a parameter indicating the turning attitude.

In the above embodiment, the deflection motor 27 that tilts the jet nozzle 35 up and down is provided, and when the roll angle θ1 or the roll angular velocity ω1 of the watercraft body 10 exceeds the respective reference values (R and γ), the jet nozzle 35 is tilted downward using the deflection motor 27. However, drive assist control using the jet nozzle 35 is only required to drive the jet nozzle 35 in a direction to stabilize the turning attitude of the watercraft body 10, and is not limited to the aspect of tilting downward. For example, in the case of a personal watercraft including an electric steering motor driven in accordance with the steering of the handle 13, that is, a personal watercraft including an electronically controlled steering system that electrically transmits the steering of the handle 13 to the jet nozzle 35, control for decreasing the left-right swing angle of the jet nozzle 35 can also be executed using the steering motor as drive assist control.

In the above embodiment, when the roll angle θ1 or the roll angular velocity ω1 exceeds the respective reference values (R and γ), the above-described control for changing the angle of the jet nozzle 35 and the control for reducing the output of the engine 4 are executed together as the drive assist control. However, only one of the control can be executed.

Furthermore, in place of or in addition to at least one of the control for output reduction of the engine 4 and the control of angle change of the jet nozzle 35, control for applying a braking force to the watercraft body 10 may be executed as drive assist control. For example, a braking member protruding from the watercraft body 10 (hull 11) so as to be able to protrude and retract into the water may be provided, and a braking force may be applied to the watercraft body 10 by increasing a protruding amount of the braking member.

In any case, as drive assist control, the behavior adjustment actuator included in the watercraft body 10 is only required to be controlled in a direction where the turning attitude of the watercraft body 10 is stabilized, and the type of the behavior adjustment actuator is not particularly limited. The behavior adjustment actuator mentioned here is an actuator capable of adjusting the behavior of the watercraft body 10, and is a concept including the engine 4 (drive source), the jet nozzle 35, and the braking member described above.

In the above embodiment, the reference values such as the reference roll angle R, the reference roll angular velocity γ, and the reference yaw angular velocity λ are variably set in accordance with the respective parameters of the operation mode, the planing speed, the steering angle, the pitch angle θ2, and the mounted object, but the parameters for determining the respective reference values are not limited thereto. For example, the reference value may be changed in accordance with the position information of the watercraft body 10. Specifically, it is conceivable to reduce the reference value when it is confirmed that the watercraft body 10 is planing in an area with a speed limit based on the position information or the like specified by the GPS receiver 54.

In the above embodiment, the internal combustion engine 4 is used as the source of the propulsive force applied to the watercraft body 10, that is, the drive source, but the drive source is not limited to the engine. For example, an electric motor may be used as a drive source, or a hybrid drive source in which an electric motor and an engine are combined may be used.

In the above embodiment, an example in which the present disclosure is applied to the personal watercraft 1 that planes by the jet water flow injected from the jet pump 3, that is, the jet propulsion watercraft, has been described. However, the personal watercraft to which the present disclosure can be applied is only required to be a personal watercraft capable of moving on water in a planing state of planing on the water surface, and is not limited to the jet propulsion watercraft. Preferably, the present disclosure can be applied to a saddle-ride type propulsion watercraft in which the attitude of the watercraft body tends to greatly change due to the weight movement or the turning operation of the driver.

In the above embodiment, as an example of the personal watercraft according to the present disclosure, the straddle-type personal watercraft 1 including the seat 14 has been exemplified. However, the personal watercraft may be of a stand-up type on which the driver rides in a standing position.

SUMMARY

The embodiment and modifications thereof include the following disclosure.

A personal watercraft according to one aspect of the present disclosure includes: a watercraft body; an operation unit operated by a driver aboard the watercraft body; a turning attitude detection unit that detects a turning attitude that is an attitude of the watercraft body when the driver performs operation of turning the watercraft body; a behavior adjustment actuator that adjusts behavior of the watercraft body; and a control unit that controls the behavior adjustment actuator based on the turning attitude detected by the turning attitude detection unit.

According to the present disclosure, by performing behavior adjustment based on the attitude of the watercraft body during turning, it is possible to assist the turning operation of the driver and reduce the operation load.

Preferably, when the turning attitude deviates from a predetermined reference, the control unit executes drive assist control for driving the behavior adjustment actuator in a direction where the turning attitude is returned to the reference.

In this aspect, the turning attitude can be stabilized by the drive assist control, and the operation load at the time of turning can be reduced.

Preferably, the personal watercraft further includes a watercraft speed sensor that detects a planing speed of the watercraft body. The reference is variably set in accordance with the planing speed detected by the watercraft speed sensor.

In this aspect, it is possible to set an appropriate reference in consideration of a difference in centrifugal force acting on the watercraft body.

Preferably, the operation unit includes a steering handle for changing a traveling direction of the watercraft body. The reference is variably set in accordance with a steering angle of the steering handle.

In this aspect, it is possible to set an appropriate reference in consideration of a difference in centrifugal force acting on the watercraft body.

Preferably, the personal watercraft further includes a mounted object sensor that detects mounting of a mounted object other than the driver onto the watercraft body. The reference is variably set in accordance with a detection result of the mounted object sensor.

In this aspect, it is possible to set an appropriate reference in consideration of presence or absence of a mounted object.

Preferably, the personal watercraft further includes: a drive source that generates a drive force for causing the watercraft body to plane; and a mode selection unit capable of selecting, as an output mode of the drive source, one of a first output mode and a second output mode in which output is suppressed more than in the first output mode. The reference is variably set in accordance with an output mode selected by the mode selection unit.

In this aspect, it is possible to set an appropriate reference in consideration of a difference in the output mode.

Preferably, the personal watercraft further includes a pitch angle sensor that detects a pitch angle that is an angle in a pitch direction of the watercraft body. The reference is variably set in accordance with the pitch angle detected by the pitch angle sensor.

In this aspect, it is possible to set an appropriate reference in consideration of a difference in sinking degree of the watercraft body underneath the surface, in other words, planing resistance of the watercraft body.

Preferably, the turning attitude detected by the turning attitude detection unit includes a roll angle that is an angle in a roll direction of the watercraft body with respect to a vertical line, or a roll angle change that is a change in the roll angle.

In this aspect, it is possible to appropriately assist the turning operation of the driver by performing behavior adjustment based on the roll attitude during turning.

Preferably, when the roll angle or the roll angle change exceeds a predetermined reference value, the control unit executes drive assist control for driving the behavior adjustment actuator in a direction of suppressing rolling of the watercraft body.

In this aspect, it is possible to stabilize the roll attitude of the watercraft body and reduce the operation load at the time of turning.

The personal watercraft may further include a jet propulsion mechanism that applies a propulsive force to the watercraft body by injecting a jet water flow from the watercraft body. The behavior adjustment actuator may include a drive source that generates a drive force for generating the jet water flow. In this case, the drive assist control for suppressing the rolling preferably includes control for reducing output of the drive source.

In this aspect, rolling can be suppressed by output reduction of the drive source.

The behavior adjustment actuator may be a jet nozzle that changes an injecting direction of the jet water flow. In this case, the drive assist control for suppressing the rolling preferably includes control for changing a direction of the jet nozzle.

In this aspect, rolling can be suppressed by changing the orientation of the jet nozzle.

Preferably, the turning attitude detected by the turning attitude detection unit includes a yaw angle change that is a change in angle in a yaw direction of the watercraft body.

In this aspect, by performing behavior adjustment based on the yaw attitude during turning, the turning operation of the driver can be appropriately assisted.

Preferably, when the yaw angle change exceeds a predetermined reference value, the control unit executes drive assist control for driving the behavior adjustment actuator in a direction of suppressing yawing of the watercraft body.

In this aspect, the yaw attitude of the watercraft body can be stabilized, and the operation load at the time of turning can be reduced.

Preferably, the drive assist control for suppressing the yawing includes control for reducing output of the drive source of the jet propulsion mechanism.

In this aspect, yawing can be suppressed by output reduction of the drive source.

Preferably, the personal watercraft further includes a display unit that displays that the drive assist control is being executed.

In this aspect, it is possible to cause the driver to recognize that drive assist is being performed.

Preferably, the personal watercraft further includes: a position information acquisition unit that acquires position information of the watercraft body; and a storage unit that stores, in association with the position information acquired by the position information acquisition unit, the turning attitude detected by the turning attitude detection unit.

In this aspect, the history of turning attitude can be reproduced and provided to the driver.

A personal watercraft according to another aspect of the present disclosure includes: a watercraft body; an operation unit operated by a driver aboard the watercraft body; a drive source that generates a drive force for causing the watercraft body to plane; a sensor that detects a roll angle that is an angle in a roll direction of the watercraft body with reference to a vertical line, or a roll angle change that is a change in the roll angle; and a control unit that reduces output of the drive source in a case where the roll angle or the roll angle change detected by the sensor exceeds a predetermined reference value while the driver is performing operation of turning the watercraft body.

According to the present disclosure, it is possible to stabilize the roll attitude of the watercraft body and reduce the operation load at the time of turning.

A control method according to still another aspect of the present disclosure is a method for controlling a personal watercraft including a watercraft body and an operation unit operated by a driver aboard the watercraft body, the method including: detecting a turning attitude that is an attitude of the watercraft body when the driver is performing operation of turning the watercraft body; and adjusting behavior of the watercraft body such that the turning attitude returns to a predetermined reference when the turning attitude having been detected deviates from the reference.

According to the method according to the present disclosure, the same effects as those of the personal watercraft disclosed above can be obtained.

The invention claimed is:

1. A personal watercraft comprising:

a watercraft body;

a user interface operated by a driver aboard the watercraft body;

a turning attitude detector that detects a turning attitude that is an attitude of the watercraft body when the driver performs operation of turning the watercraft body;

a behavior adjustment actuator that adjusts behavior of the watercraft body; and control circuitry configured to control the behavior adjustment actuator based on the turning attitude detected by the turning attitude detector, wherein when the turning attitude deviates from a reference, the control circuitry drives the behavior adjustment actuator in a direction where the turning attitude is returned to the reference, and the control circuitry variably sets the reference in accordance with information regarding the personal watercraft.

2. The personal watercraft according to claim 1, further comprising:

a watercraft speed sensor that detects a planing speed of the watercraft body as the information regarding the personal watercraft, wherein the control circuitry variably sets the reference in accordance with the planing speed detected by the watercraft speed sensor.

3. The personal watercraft according to claim 1, wherein;

the user interface includes a steering handle for changing a traveling direction of the watercraft body, and the control circuitry variably sets the reference in accordance with a steering angle of the steering handle as the information regarding the personal watercraft.

4. A personal watercraft, comprising:

a watercraft body;

a user interface operated by a driver aboard the watercraft body;

a turning attitude detector that detects a turning attitude that is an attitude of the watercraft body when the driver performs operation of turning the watercraft body;

a behavior adjustment actuator that adjusts behavior of the watercraft body;

control circuitry configured to control the behavior adjustment actuator based on the turning attitude detected by the turning attitude detector; and a mounted object sensor that detects an object other than the driver mounted on the watercraft body, wherein:

when the turning attitude deviates from a reference, the control circuitry executes drive assist control for driving the behavior adjustment actuator in a direction where the turning attitude is returned to the reference, and the control circuitry variably sets the reference in accordance with a detection result of the mounted object sensor.

5. A personal watercraft, comprising:

a watercraft body;

a user interface operated by a driver aboard the watercraft body;

a turning attitude detector that detects a turning attitude that is an attitude of the watercraft body when the driver performs operation of turning the watercraft body;

a behavior adjustment actuator that adjusts behavior of the watercraft body;

control circuitry that controls the behavior adjustment actuator based on the turning attitude detected by the turning attitude detector;

a drive source that generates a drive force for causing the watercraft body to plane; and a mode selector to select, as an output mode of the drive source, one of a first output mode and a second output mode in which output is suppressed more than in the first output mode, wherein;

when the turning attitude deviates from a reference, the control circuitry executes drive assist control for driving the behavior adjustment actuator in a direction where the turning attitude is returned to the reference, and the control circuitry variable sets the reference in accordance with an output mode selected by the mode selector.

6. The personal watercraft according to claim 1, further comprising:

a pitch angle sensor that detects a pitch angle that is an angle in a pitch direction of the watercraft body as the information regarding the personal watercraft, wherein the reference is variably set in accordance with the pitch angle detected by the pitch angle sensor.

7. The personal watercraft according to claim 1, wherein the turning attitude detected by the turning attitude detector includes a roll angle that is an angle in a roll direction of the watercraft body with respect to a vertical line, or a roll angle change that is a change in the roll angle.

8. The personal watercraft according to claim 7, wherein;

when the roll angle or the roll angle change exceeds the reference, the control circuitry executes drive assist control for driving the behavior adjustment actuator in a direction of suppressing rolling of the watercraft body.

9. The personal watercraft according to claim 8, further comprising:

a pump that applies a propulsive force to the watercraft body by injecting a jet water flow from the watercraft body, wherein:

the behavior adjustment actuator includes a drive source that generates a drive force for generating the jet water flow, and the drive assist control includes control for reducing output of the drive source.

10. The personal watercraft according to claim 8, further comprising:

a pump that applies a propulsive force to the watercraft body by injecting a jet water flow from the watercraft body, wherein:

the behavior adjustment actuator includes a jet nozzle that changes an injecting direction of the jet water flow, and the drive assist control includes control for changing a direction of the jet nozzle.

11. The personal watercraft according to claim 1, wherein;

the turning attitude detected by the turning attitude detector includes a yaw angle change that is a change in angle in a yaw direction of the watercraft body.

12. The personal watercraft according to claim 11, wherein;

when the yaw angle change exceeds the reference, the control circuitry executes drive assist control for driving the behavior adjustment actuator in a direction of suppressing yawing of the watercraft body.

13. The personal watercraft according to claim 12, further comprising:

a pump that applies a propulsive force to the watercraft body by injecting a jet water flow from the watercraft body, wherein:

the behavior adjustment actuator includes a drive source that generates a drive force for generating the jet water flow, and the drive assist control includes control for reducing output of the drive source.

14. A personal watercraft, comprising:

a watercraft body;

a user interface operated by a driver aboard the watercraft body;

a turning attitude detector that detects a turning attitude that is an attitude of the watercraft body when the driver performs operation of turning the watercraft body;

a behavior adjustment actuator that adjusts behavior of the watercraft body;

control circuitry that controls the behavior adjustment actuator based on the turning attitude detected by the turning attitude detector; and a display, wherein:

when the turning attitude deviates from a reference, the control circuitry executes drive assist control for driving the behavior adjustment actuator in a direction where the turning attitude is returned to the reference, and the display displays that the drive assist control is being executed.

15. A personal watercraft, comprising:

a watercraft body;

a user interface operated by a driver aboard the watercraft body;

a turning attitude detector that detects a turning attitude that is an attitude of the watercraft body when the driver performs operation of turning the watercraft body;

a behavior adjustment actuator that adjusts behavior of the watercraft body;

control circuitry that controls the behavior adjustment actuator based on the turning attitude detected by the turning attitude detector;

a position sensor to acquire position information of the watercraft body; and a memory that stores, in association with the position information acquired by the position sensor, the turning attitude detected by the turning attitude detector.

16. A personal watercraft comprising:

a watercraft body;

a user interface operated by a driver aboard the watercraft body;

a drive source that generates a drive force for causing the watercraft body to plane;

a sensor that detects a roll angle that is an angle in a roll direction of the watercraft body with reference to a vertical line, or a roll angle change that is a change in the roll angle; and control circuitry that reduces output of the drive source in a case where the roll angle or the roll angle change detected by the sensor exceeds a reference while the driver is performing operation of turning the watercraft body, wherein the control circuitry variably sets the reference in accordance with information regarding the personal watercraft.

17. A method for controlling a personal watercraft, the method comprising:

detecting a turning attitude that is an attitude of a watercraft body when a driver is performing operation of turning the watercraft body;

adjusting behavior of the watercraft body such that the turning attitude returns to a reference when the turning attitude having been detected deviates from the reference; and variably setting the reference in accordance with information regarding the personal watercraft.

* * * * *